United States Patent [19]

Ericsson

[11] Patent Number: 4,538,358

[45] Date of Patent: Sep. 3, 1985

[54] DRYING PLANT FOR DRYING PRINTED MATERIAL

[75] Inventor: Sylve J. D. Ericsson, Tumba, Sweden

[73] Assignee: Svecia Silkscreen Maskiner AB, Norsborg, Sweden

[21] Appl. No.: 557,935

[22] Filed: Dec. 5, 1983

[30] Foreign Application Priority Data

Dec. 16, 1982 [SE] Sweden ..... 8207200

[51] Int. Cl.[3] ..... F26B 23/04

[52] U.S. Cl. ..... 34/4; 34/41; 118/642

[58] Field of Search ..... 34/4, 41, 68; 118/641, 118/642, 643

[56] References Cited

U.S. PATENT DOCUMENTS 4,015,340 4/1977 Treleven ..... 34/4

*Primary Examiner*—Larry I. Schwartz

*Attorney, Agent, or Firm*—Burns, Doane, Swecker & Mathis

[57] ABSTRACT

A drying plant for drying printed material includes a material conveying means (3) and a plurality of print drying devices (4*a*, 4*b*). One or more first drying devices for drying print (6) are arranged on one printed side (5*a*) of the substrate material so as to face said side, while one or more second drying devices (4*b*) are arranged on an opposite side (5*b*) of said substrate material so as to face said opposite side; The second drying devices (4*b*) are arranged to act upon the printed part (6) of the substrate material in a drying and/or curing mode, before said part (6) is acted upon by the first drying devices (4*a*) in a similar mode.

8 Claims, 3 Drawing Figures

DRYING PLANT FOR DRYING PRINTED MATERIAL

TECHNICAL FIELD

The present invention relates to a drying plant for drying print applied to a substrate material. The print can be applied by any known means whatsoever, for example by printing machines, although the invention assumes that the print has been applied, to advantage, with the aid of a silk-screen printer. The drying plant includes one or more conveyor means, for transporting the substrate material through said plant. The drying plant also includes a plurality of print drying devices. Although the drying plant can be used for drying print by evaporation of the solvent used therein, or by means of other drying processes, the desired drying process will hereinafter be referred to as "curing", for the sake of simplicity.

BACKGROUND ART

Various drying plants intended for drying the plant on freshly printed material are known to the art, said print being applied by printing machines, for example silk-screen printers.

In the majority of these known drying plants, the print-drying devices face the printed side of said material and are located adjacent said side. It is known in this respect to adapt the intensity of the drying device to the speed at which the material is conveyed through the plant and to the print in question, so that the print or print coating is thoroughly dried or cured.

One condition in this respect is that the print or print coating has a thickness which enables it to be thoroughly dried or cured from solely one side of the material.

When drying three dimensional objects, it is also known to arrange print-drying devices on respective sides of the object, so as to dry print on mutually different parts of the object simultaneously.

DESCRIPTION OF THE INVENTION

Technical Problem

It has been found problematic to design and dimension the print drying devices arranged on and facing towards the printed side of said substrate material in a manner such as to ensure that the print is thoroughly dried and/or cured. This is particularly true when the print is relatively thick.

Efforts made towards this end have indicated that only the upper surface of the print is cured as a result of the intensive action of the print drying devices. Consequently, the layer nearest the substrate material remains uncured, and the print is not thoroughly cured throughout.

An increase in the intensity of the print drying devices results in a wrinkled upper skin, but there is not obtained a thorough curing of the print throughout the whole of its thickness.

Consequently, the problem of creating conditions in which the print coating is cured throughout the whole of its thickness has been found to be of a highly qualified technical nature. Another technical problem is one of succeeding in adhering the print to certain substrate surfaces, such as glass for example, during a curing process. A more qualified technical problem in this respect is one causing the bottom surface of a thick print coating to adhere to said material. This problem has been found particularly troublesome when the printing inks or printing substances are to be of a nature such as to afford protection (permanent protection) against ultraviolet radiation, and when the print drying devices comprise, at the same time, lamps which generate ultraviolet radiation, so-called UV-lamps, for curing the print coating.

Consequently, in the latter application, normally only that part of the print coating, or a fraction of said part, which faces the print drying devices is cured, while that part, or those parts, of the print coating which faces, or face, the material remain totally or partially uncured.

The abovementioned problems are particularly pronounced when a thick print is applied to a thick material, and it has been found particularly troublesome to apply so-called ceramic penetration inks to glass material. In this latter case it has been found by practical experience that only the upper part of the print coating rests against an uncured film of printing ink.

SOLUTION

There is now provided in accordance with the invention a drying plant for drying printed material, said plant comprising material-conveying means and a plurality of print drying devices. In accordance with the invention, in such a drying plant one or more first print-drying devices shall be arranged on one side of the printed material so as to face said one side or a surface thereof, while one or more second print-drying devices shall be arranged on the other side of said material so as to face said other side or a surface thereof. It is also important that the second drying devices are so arranged that they are able to dry and/or cure a printed part of said material, before said printed part is subjected to a drying and/or curing process by the first print-drying devices.

In this way it is possible to ensure that the aforementioned problems do not arise.

Conveniently, the print-drying devices may comprise means for generating ultraviolet radiation, and, particularly when the material to be printed has the form of a glass plate, that part of the printing ink or print coating lying against the material shall be cured befor curing a part of the print lying above the firstmentioned part.

The invention affords a particular advantage when the print applied to said material comprises a thick print or a thick print coating, preferably heavily pigmented, since that part of the printing ink or printing composition lying against the substrate material can be fused to or burned into the substrate material by said second drying devices, while the remaining overlying part of said print is able to dry/cure against the fused part thereof, said part being already cured.

ADVANTAGES

The main advantages afforded by a drying plant constructed in accordance with the invention are that a thick layer of printing ink or print coating can be thoroughly cured or dried throughout, by first drying and/or curing the printing ink or print coating through a first activation of only certain parts of the print coating.

The main characterizing features of a drying plant according to the invention, for drying printed material and including a material conveying means and a plurality of print drying devices are set forth in the characterizing clause of the accompanying claim 1.

BRIEF DESCRIPTION OF THE DRAWING

An embodiment of the invention at present preferred and disclosing significant characterizing features of the invention will now be described in greater detail with reference to the accompanying drawing, in which.

DESCRIPTION OF A PREFERRED EMBODIMENT

Figure 1:
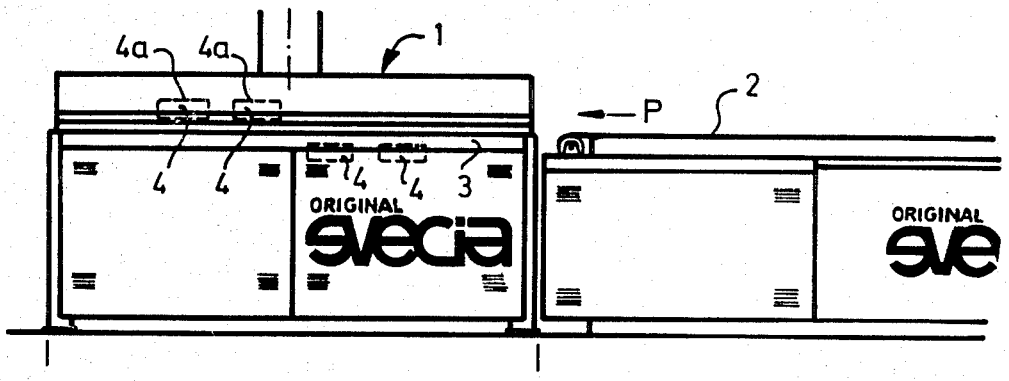
FIG. 1 is a side view of a drying plant constructed in accordance with the invention.

In FIG. 1 there is shown a drying plant 1 for drying print which has been applied to a substrate material. The substrate material, not shown in FIG. 1, is delivered to an inspection table 2 from a silk screen printer (not shown) in the direction of arrow P, and from there to an adjacently lying drying plant 1. The drying plant includes a conveying means 3 for the transportation of said substrate material, and a plurality of devices 4 for drying the print applied.

Figure 2:
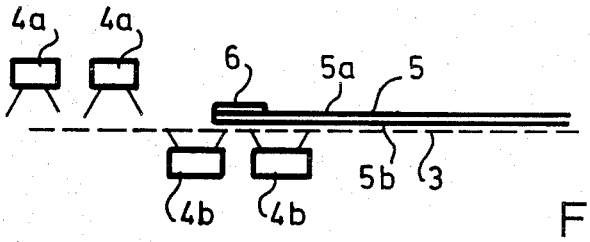
FIG. 2 illustrates a length of printed substrate material during its passage through the plant.
Figure 3:
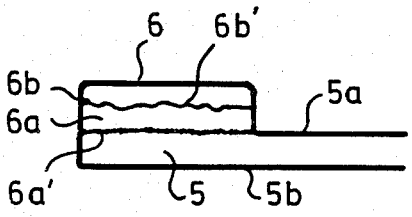
FIG. 3 illustrates an edge portion of a piece of substrate material on which a print coating has been applied.

Referring to FIG. 2, it will be seen that one or more first print-drying devices 4*a* are arranged on one, printed side 5*a* of the substrate material 5 so as to face said side 5*a* or a surface thereon; and that one or more second print drying devices 4*b* are arranged on the other side 5*b* of said substrate material, so as to face said other side or a surface thereon. It will also be seen from FIG. 2 that the second drying devices are arranged to first act upon a printed part 5 of the substrate material in a drying and/or curing mode, before said printed part is acted upon by the first drying devices 4*a*.

In accordance with one embodiment of the invention, the print drying devices comprise UV-radiation means (means which generate ultraviolet radiation).

The substrate material 5 may advantageously have the form of a glass plate or the like, with which a part 6*a* of the printing ink 6, or a printing-ink section 6, laying against the surface 5*a* of the substrate material is caused to cure prior to the curing of a part 6*b* of said printing ink 6 lying thereabove. Curing of the print is thus effected in two stages.

The applied print, or said part 6*a*, comprises a thick ink or a thick print coating, preferably heavily pigmented. When applying the drying and/or curing process proposed in accordance with the invention, it is possible to fuse a layer 6*a'* of said part 6*a* to the surface 5*a* of the substrate material, by means of the second drying devices 4*b*, while the upper part 6*b* of said print is dried and/or cured by the drying devices 4*a*.

Consequently, the intensity of the devices 4*b* should be selected in dependence upon the speed at which the substrate material 5 is conveyed through the plant, so as to thoroughly dry and/or cure the print coating 6, without the formation of a pronounced binding layer 6*b'* between the parts 6*a* and 6*b*.

It has been found particulaly difficult to fuse a print coating to a glass substrate, when the print coating consists of a substance which is intended to permanently prevent the passage of UV-radiation through the print coating and act deleteriously on the glue layer applied to the opposite side of the print coating. When the ultraviolet-generating, drying and/or curing devices are placed on only one side of the substrate material, normally the upper side, during a drying operation, the UV-radiation will only cure the upper part 6*b* of the print coating 6, and consequently the print will not adhere to the glass. According to the invention, that part 6*a* of the print which lies against the glass substrate 5 shall be cured first and burned into, or fused with, the upper surface 5*a* of said substrate 5, and the complete curing of said print coating is effected in a subsequent stage, through the agency of the devices 4*a*.

A particularly difficult printing ink or printing composition in this respect is the ceramic penetrating ink retailed under the designation Black 39135/137/63, and produced by Blythe Colours B. V. Fregatweg 38, Maastricht, Holland. The ink is used to advantage on the edge portions of vehicle windscreens, so that they can be bonded to the chassis via an adhesive applied to the surface 5*b*, the printing composition protecting the adhesive from attack by harmful atmospheric ultraviolet radiation.

The invention is not restricted to the described and illustrated embodiment, but can be modified within the scope of the following claims.

I claim:

1. A drying plant for drying printing substance applied to a first surface of a radiation transmissive substrate, said drying plant comprising:

means for conveying said material along a path;

means for irradiating an opposite surface of said substrate from said first surface as said substrate is conveyed along a first portion of said path so to cure a first layer of the printing substance adjacent said first surface of the material;

means for irradiating said first surface as said substrate is conveyed along a subsequent portion of said path so to cure the remaining layer of said printing substance.

2. The drying plant according to claim, 1 wherein said means for irradiating an opposite surface and said means for irradiating said first surface are UV-radiating devices.

3. The drying plant according to claim 1, wherein the substrate is a glass plate.

4. The drying plant according to claim 1, wherein the printing substance applied to said substrate comprises thick printing substance and said means for irradiating an opposite surface fusing said first layer to said substrate.

5. The drying plant according to claim 2, wherein the substrate is a glass plate.

6. The drying plant according to claim 2, wherein the printing substance applied to said substrate comprises thick printing substance and said means for irradiating an opposite surface fusing said first layer to said substrate.

7. The drying plant according to claim 3, wherein the printing substance applied to said substrate comprises thick printing substance and said means for irradiating an opposite surface fusing said first layer to said substrate.

8. The drying plant according to claim 5, wherein the printing substance applied to said substrate comprises thick printing substance and said means for irradiating an opposite surface fusing said first layer to said substrate.

* * * * *